US008136256B2

(12) United States Patent
Wolf et al.

(10) Patent No.: US 8,136,256 B2
(45) Date of Patent: Mar. 20, 2012

(54) MOTOR CHAIN SAW

(75) Inventors: Günter Wolf, Oppenweiler (DE); Gerhard Pfleiderer, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 659 days.

(21) Appl. No.: 12/233,648

(22) Filed: Sep. 19, 2008

(65) Prior Publication Data

US 2009/0077815 A1 Mar. 26, 2009

(30) Foreign Application Priority Data

Sep. 21, 2007 (DE) ..... 10 2007 045 240

(51) Int. Cl.
*B27B 17/02* (2006.01)

(52) U.S. Cl. ..... 30/383; 30/381

(58) Field of Classification Search ..... 30/381–387; 83/830–834

See application file for complete search history.

(56) References Cited

U.S. PATENT DOCUMENTS

| | | | | | |
|---|---|---|---|---|---|
| 3,870,125 | A | * | 3/1975 | Gorski | 30/383 |
| 3,967,378 | A | * | 7/1976 | Arff et al. | 30/383 |
| 4,117,594 | A | * | 10/1978 | Arbuckle | 30/381 |
| H294 | H | * | 7/1987 | Hiraizumi et al. | 30/383 |
| 4,819,332 | A | * | 4/1989 | Sugihara et al. | 30/383 |
| 5,353,506 | A | | 10/1994 | Müller et al. | |

* cited by examiner

*Primary Examiner* — Stephen Choi
(74) *Attorney, Agent, or Firm* — Gudrun E. Huckett

(57) ABSTRACT

A motor chain saw has a housing, a motor arranged in the housing, a drive pinion driven by the motor, and a guide bar connected to the housing. A saw chain is driven in circulation about the guide bar by the drive pinion. A lateral panel is arranged between the housing and an attachment section of the guide bar. The guide bar and the lateral panel each have a distance relative to the drive pinion upstream and downstream of the drive pinion when viewed in a circulating direction of the saw chain. The lateral panel has a first guide that guides the saw chain at a level of rivets of the saw chain, wherein the first guide extends approximately parallel to the plane of the guide bar.

14 Claims, 5 Drawing Sheets

MOTOR CHAIN SAW

BACKGROUND OF THE INVENTION

The invention relates to a motor chain saw comprising a guide bar and a saw chain circulating about the guide bar. The chain saw comprises a housing on which the guide bar is secured and a lateral panel arranged between the housing and the guide bar in the fastening area of the guide bar. The saw chain is driven by a drive pinion. The guide bar and the lateral panel are spaced at a distance relative to the drive pinion upstream and downstream of the drive pinion when viewed in the circulating direction of the saw chain.

U.S. Pat. No. 5,353,506 discloses a motor chain saw in which between guide bar and housing a lateral panel is arranged. This lateral panel extends at the level of the saw chain, i.e., above and below the guide bar, at a slant relative to the plane of the guide bar.

SUMMARY OF THE INVENTION

It is an object of the present invention to provide an improved motor chain saw of the aforementioned kind.

In accordance with the present invention, this is achieved in that a guide for the saw chain is provided on the lateral panel at the level of a rivet of the saw chain, wherein the guide extends approximately parallel to the plane of the guide bar.

The guide provided on the lateral panel improves the lateral guiding action of the saw chain. Tilting of the saw chain can be prevented to a large extent. In this way, it is possible to prevent by simple means damage caused by the saw chain on the housing. The guide prevents that the saw chain tilts toward the housing and that the cutters of the saw chain reach the area of the housing. By providing the guide on the lateral panel, no additional components such as separate guide strips on the housing of the motor chain saw are required. A simple configuration results.

Excellent guiding properties can be achieved when the guide is positioned at a distance of approximately 0.6 mm up to approximately 1 mm relative to the rivet of the saw chain when the saw chain is centrally guided on the guide bar. Particularly advantageous is a distance of approximately 0.6 mm to approximately 0.9 mm.

On the lateral panel at the level of a cutter of the saw chain a slanted section is provided which slanted section is oriented away from cutter of the saw chain. In this way, it is ensured that the cutter will not reach the area of the lateral panel. The slanted section is advantageously positioned at an angle of approximately 20 degrees to approximately 50 degrees relative to the plane of the guide. A simple configuration results when the guide and the slanted section are formed on a bulge in an upper longitudinal section of the lateral panel. Advantageously, the upper longitudinal section has a surface that relative to a baseplate of the lateral panel is slanted away from the guide bar. The base surface of the upper longitudinal section rests advantageously against a housing wall of the motor chain saw. In order to prevent that dirt, cuttings or the like will collect at the bulge between the housing and the lateral panel, it is provided that the bulge at the ends that are leading and trailing in the circulating direction pass into the base surface of the upper longitudinal section. As a result of the contact of the base surface on a housing wall of the motor chain saw, the bulge is thus of a closed configuration.

The attachment section of the guide bar and the drive pinion are covered, in particular by a sprocket wheel cover. Advantageously, the sprocket wheel cover has at least one guide on the sprocket wheel cover for guiding the rivets of the saw chain at a side that is facing away from the lateral panel. In this way, the saw chain is guided on both longitudinal sides so that tilting of the saw chain toward the sprocket wheel cover and damage of the sprocket wheel cover by cutters of the saw chain is prevented in a simple way. The guide on the sprocket wheel cover extends advantageously also approximately parallel to the plane of the guide bar. The guide on the sprocket wheel cover is in particular formed on a guide strip arranged on the sprocket wheel cover. The guide strip is comprised advantageously of plastic material. In this way, minimal friction values between the guide strip and the saw chain are achieved.

Advantageously, the lateral panel has a lower guide that is arranged in the circulating direction in front of the drive pinion on a lower longitudinal section of lateral panel. Advantageously, a ramp for the saw chain is provided in the circulating direction in front of at least one of the guides. In this way it can be ensured that the saw chain is guided in the groove of the guide bar and cannot impact laterally. In this way, damage and wear can be prevented and the service life of the motor chain saw can be increased. The ramp is particularly advantageous when the saw chain is not guided in the stretch between the drive pinion and the guide bar. Advantageously, a first ramp is provided in the circulating direction in front of the guide on the lateral panel. A second ramp is provided in particular in the circulating direction in front of the guide provided on the sprocket wheel cover. In order to achieve centering of the saw chain between the two guides, it is provided that the first and the second ramps in the circulating direction of the saw chain converge in a V-shape. In this way, a safe guiding action for the saw chain and at the same time a gradual return of a tilted saw chain can be achieved. Wear and noise development can be kept at a minimum in this way. Advantageously, a lower ramp is provided in the circulating direction in front of the lower guide on the lateral panel.

The lateral panel has expediently at least one opening for fastening means of the guide bar and at least one lubricating groove for supplying a lubricant to the guide bar. The lateral panel can thus be arranged in the area of the fastening means and in the area of the lubricant supply.

Advantageously, the lateral panel is in the form of a bent (shaped) sheet metal. In particular, the lateral panel is produced by a combined stamping and bending process. The guides and the ramps as well as the openings of the lateral panel can therefore be produced in a simple way in one processing step.

DESCRIPTION OF THE PREFERRED EMBODIMENTS

Figure 1:
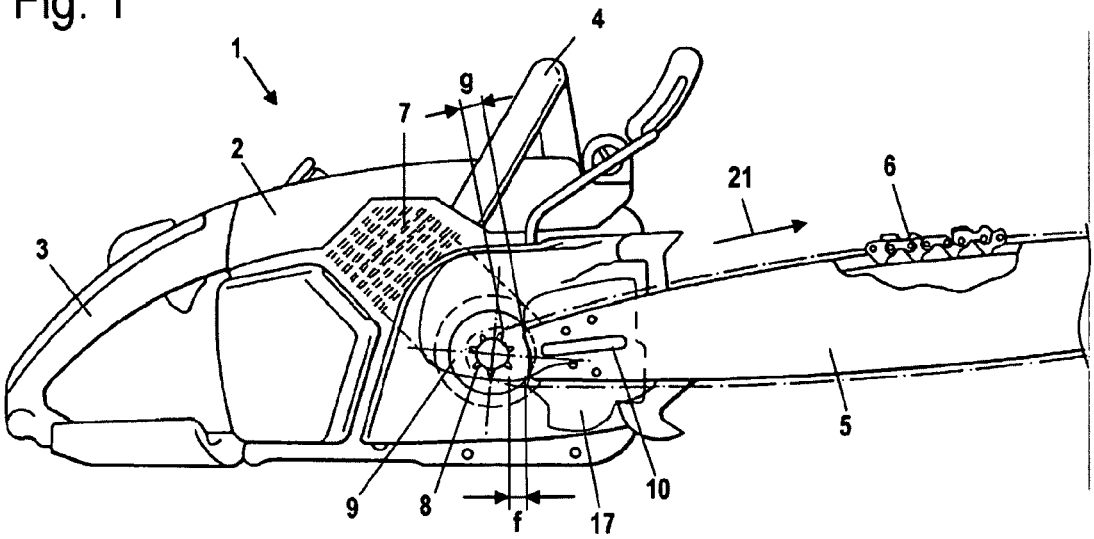
FIG. 1 is a schematic side view of a motor chain saw.

FIG. 1 shows an example of a motor chain saw in the form of a portable, hand-guided motor chain saw 1. The term motor chain saw is meant to include generally all types of power tools, in particular, hand-guided portable power tools, where a saw chain is driven in circulation about a guide bar. These include also, for example, pole pruners and the like.

The motor chain saw 1 of FIG. 1 has a housing 2 provided with a rear handle 3 as well as a grip pipe 4 for guiding the motor chain saw 1 in operation. A drive motor 7 is arranged in the housing 2. The drive motor is in particular an internal combustion engine, advantageously a two-stroke engine or a mixture-lubricated four-stroke engine. However, the drive motor 7 can also be an electric drive motor. The drive motor 7 drives in rotation a drive pinion 8. On the housing 2 a guide bar 5 is secured on which saw chain 6 is arranged. The saw chain 6 is guided about the drive pinion 8 and is driven by it in the circulating direction 21. In the illustrated embodiment, the drive pinion 8 is arranged on a clutch drum 9 of a clutch that is arranged between the drive shaft of the drive motor 7 and the drive pinion 8.

Between the guide bar 5 and the housing 2 a lateral panel 17 is arranged that is a monolithic part and is formed as a bent sheet metal that protects the housing 2 in the area of attachment of the guide bar 5 on the housing 2. Between the guide bar 5 and the drive pinion 8, viewed in the circulating direction 21 of the saw chain 6, a distance f is provided and at the upper run of the saw chain 6 between the drive pinion 8 and the guide bar 5 there is a distance g. The lateral panel 17 ends approximately flush with the guide bar 5 so that the distances f and g are also provided between the lateral panel 17 and the drive pinion 8. In this way, the guide bar 5 is not supported between drive pinion 8 and the guide bar 5.

Figure 2:
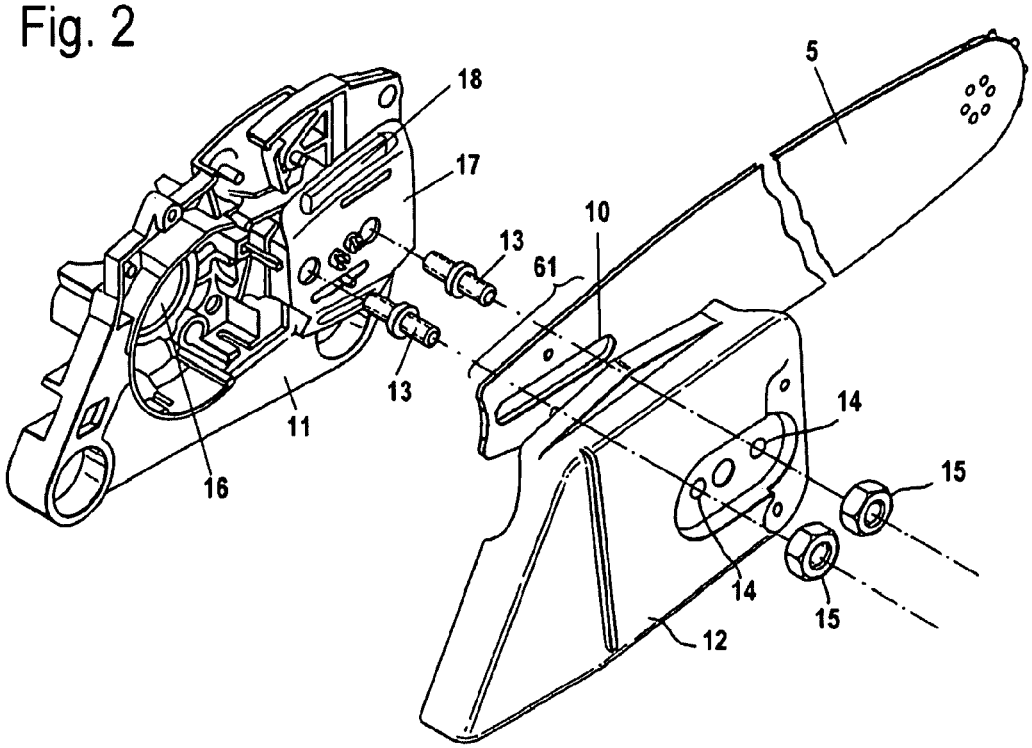
FIG. 2 is a perspective detail view in an exploded illustration of the motor chain saw of FIG. 1.

FIG. 2 shows the attachment of the guide bar 5 on the housing 2. In the area of contact of the guide bar 5 the housing 2 is formed as a housing wall 11. The housing wall 11 has an opening 16 through which the drive shaft (not illustrated) of the drive motor 7 projects. The lateral panel 17 rests against the housing wall 11. For securing the guide bar 5, two screw bolts 13 are provided that are screwed into the housing 2. The guide bar 5 has an attachment section 61 in which the guide bar 5 is provided with a slotted hole 10. For securing it on the housing 2, the guide bar 5 is placed with the slotted hole 10 onto the screw bolts 13 projecting from the housing 2.

For covering the guide bar 5 in the attachment section 61 and for covering the drive pinion 8 (not shown in FIG. 2), a sprocket wheel cover 12 is provided. The sprocket wheel cover 12 has two openings 14 for the screw bolts 13. For securing the guide bar 5 and the sprocket wheel cover 12, two nuts 15 are provided that are screwed on from the exterior side of the sprocket wheel cover 12 onto the screw bolts 13. In this way, the guide bar 5 and the lateral panel 17 are secured by being clamped between the sprocket wheel cover 12 and the housing wall 11.

Figure 3:
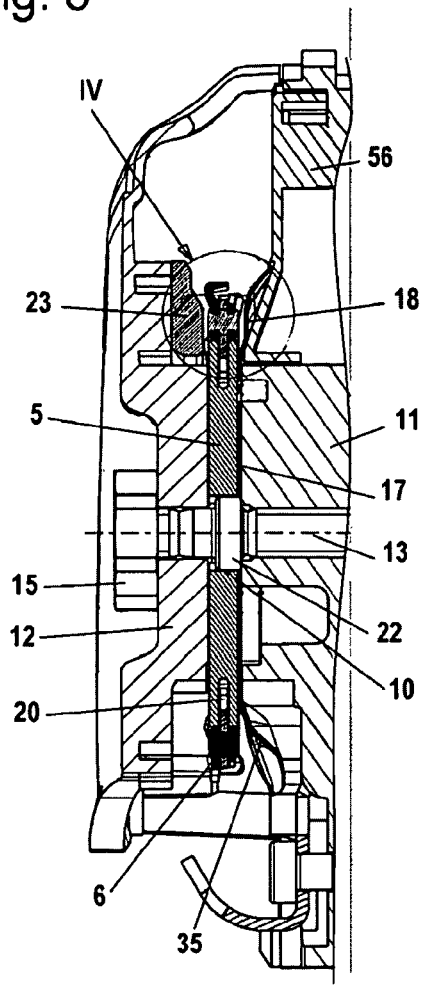
FIG. 3 is a section illustration of the sprocket wheel cover, guide bar, and housing of the motor chain saw.

FIG. 3 shows a section through the motor chain saw 1 in the area of the guide bar 5 with the guide bar 5 in the secured position. As shown in FIG. 3, the screw bolt 13 has a collar 22 that is arranged in the slotted hole 10 of the guide bar 5. The guide bar 5 has a guide groove 20 in which the saw chain 6 is guided with its drive links 30 (FIG. 4).

On the lateral panel 17 a first guide 18, also shown in FIG. 2, is provided for guiding the saw chain 6. The first guide 18 is arranged on the side of the lateral panel 17 where the saw chain moves away from the drive pinion 8. As can be seen also in the detail illustration in FIG. 4, the guide 18 extends parallel to the plane of guide bar 5 and parallel to the planar lateral face 55 of a rivet 25 of the saw chain 6. The guide 18 is arranged at the level of the rivet 25, i.e., above the outer edge of the guide bar 5 at a distance b to the lateral face 55 of the rivet 25. The distance b is advantageously approximately 0.5 mm to 1.0 mm. In particular, this distance b is 0.6 mm to 0.9 mm.

On the opposite side of the saw chain 6 a guide strip 23 is arranged on the sprocket wheel cover 12. The guide strip 23 is comprised advantageously of plastic material. On the guide strip 23 a second guide 24 provided on the sprocket wheel cover 12 is formed that is also parallel to a lateral face 55 of the rivet 25. The guide 24 on the sprocket wheel cover 12 is thus parallel to the guide 18 provided on the lateral panel 17 and parallel to the plane of the guide bar 5. The guide 24 on the sprocket wheel cover 12 has a distance a to the lateral face 55 of the rivet 25; this distance a is advantageously 0.5 mm to 1.0 mm, in particular 0.6 mm to 0.9 mm. Advantageously, the distances a and b are identical. In this way, the rivet 25 is guided on both sides of the guide bar 5. Tilting of the saw chain 6 is thus prevented.

Figure 4:
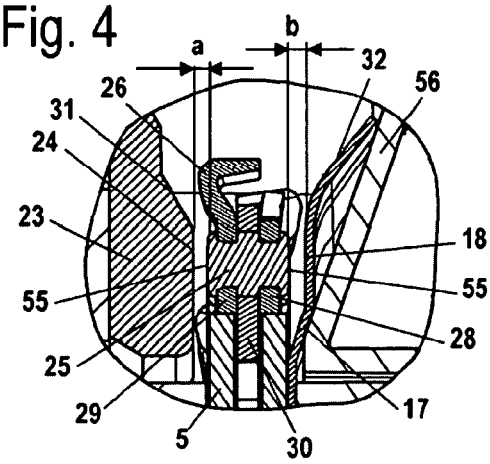
FIG. 4 shows detail IV of FIG. 3 in an enlarged view.

In the position of the saw chain 6 shown in FIG. 4, the saw chain 6 has on the side of the drive link 30 that is facing the guide 18 a connecting link 28, and on the opposite side that is facing the second guide 24 the saw chain 6 has a cutting link 29. On the cutting link 29 a right cutter 26 is formed. The right cutter 26 projects past the lateral face 55 of the rivet 25 that faces the guide 24 on the sprocket wheel cover 12 in the direction toward the guide strip 23. At the level of the cutter 26 the guide strip 23 has a slanted section 31 that is slanted away from the cutter 26.

The lateral panel 17 has at the level of the cutter 26 a slanted section 32 where the lateral panel 17 is slanted away from the plane of the guide bar 5. In the area of the guide 18 and the slanted section 32 the lateral panel 17 is arranged on a housing wall 56 of the housing 2.

Figure 5:
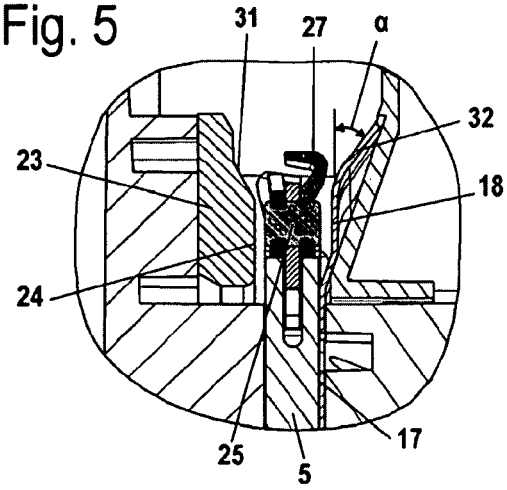
FIG. 5 shows the detail IV of FIG. 3 with a left cutter.

FIG. 5 shows the detail of FIG. 4 in a position of the saw chain 6 in which a left cutter 27 is arranged on the side of the saw chain 6 facing the lateral panel 17. As shown in FIG. 5, the slanted section 32 is arranged at the level of cutter 27. The slanted section 32 is slanted relative to the plane of the guide 18 about an angle $\alpha$ that is advantageously approximately 20 degrees up to approximately 50 degrees. Especially, the angle $\alpha$ is approximately 30 degrees to 40 degrees.

Figure 6:
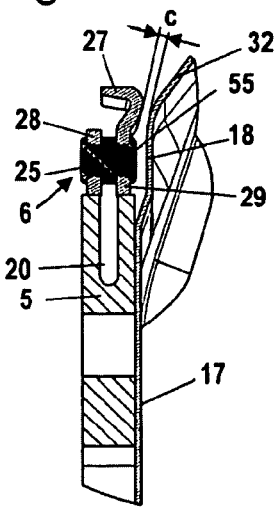
FIG. 6 is a first section view of a first position of a saw chain relative to the lateral panel.
Figure 7:
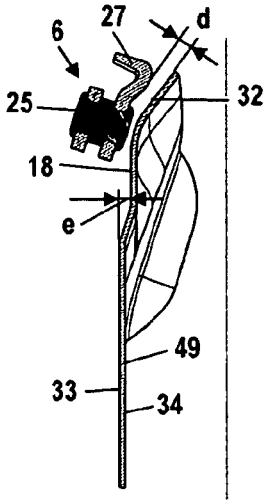
FIG. 7 is a second section view of a second position of the saw chain relative to the lateral panel.
Figure 8:
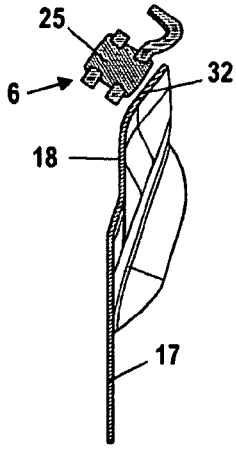
FIG. 8 is a third section view of a third position of the saw chain relative to the lateral panel.

In FIGS. 6 to 8, the saw chain 6 is shown with the left cutter 27 in different positions relative to the lateral panel 17. In the position illustrated in FIG. 6, the saw chain 6 is arranged on the guide bar 5. The lateral face 55 of the rivet 25 facing the first guide 18 is positioned at the level of the first guide 18 provided on the lateral panel 17. The left cutter 27 is spaced at a distance c relative to the lateral panel 17. In this connection, the left cutter 27 is arranged at the level of the slanted section 32 at the lower area of the slanted section 32 neighboring the guide 18.

In the position illustrated in FIG. 7, the saw chain 6 is in a tilted position and is positioned at a distance to the guide bar 5 (not shown in FIG. 7). The rivet 25 is arranged in the area where first guide 18 passes into the slanted section 32. The left cutter 27 is arranged at the level of the slanted section 32 and has relative to the slanted section 32 a distance d. In the position of the saw chain 6 shown in FIG. 8, the rivet 25 is positioned at the slanted section 32. In this position the rivet 25 is still guided by the lateral panel 17.

As shown in FIGS. 6 to 8, the design of the lateral panel 17 is selected such that the saw chain 6, even in unfavorable situation when the saw chain 6 is tilted and is spaced at a distance from the guide bar 5, is still guided by the lateral panel 17. As shown in FIG. 7, the guide 18 is recessed relative to a contact surface 33 for the guide bar 5 by displacement e. The displacement e is selected such that a suitable distance d between the guide 18 and the rivet 25 of the saw chain 6 will result. The lateral panel 17 has a contact surface 34 on the side facing away from the contact surface 33 and the lateral panel 17 rests with this contact surface 34 against the housing wall 11. The contact surfaces 33 and 34 are formed on a baseplate 49 of the lateral panel 17.

Figure 9:
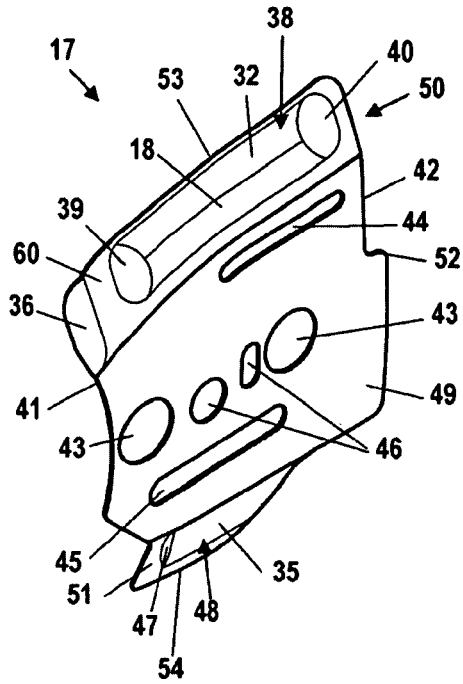
FIG. 9 shows a lateral panel in a perspective illustration.
Figure 10:
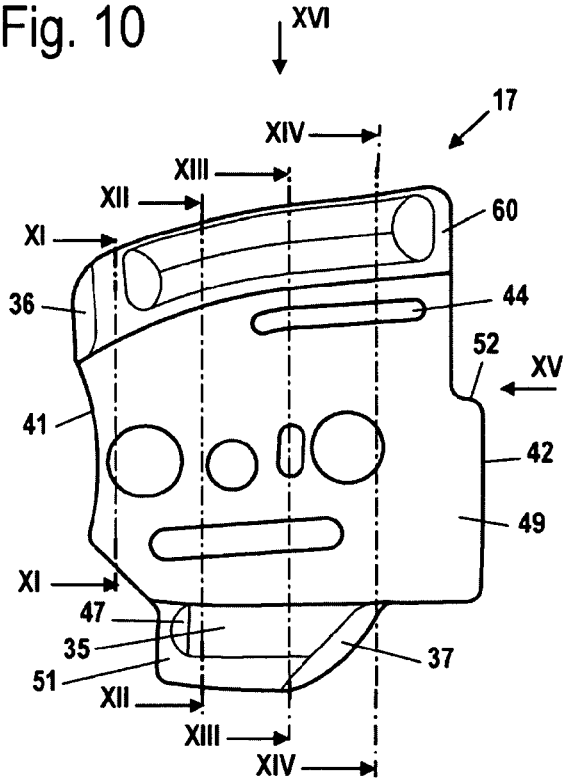
FIG. 10 shows the lateral panel of FIG. 9 in a side view.

In FIGS. 9 through 16 the lateral panel 17 is shown in detail. As illustrated in FIG. 9 and FIG. 10, the lateral panel 17 comprises a baseplate 49 that is essentially planar and on which the attachment section 61 of the guide bar 5 is to be arranged (FIG. 2). The baseplate 49 has in the shown embodiment two openings 43 for the screw bolts 13 as well as two intermediately positioned through openings 46 for adjusting elements. Adjacent to the upper longitudinal section 50 of the lateral panel 17, the baseplate 49 has a lubrication groove 44. On the opposite side of the baseplate 49 a longitudinal groove 45 is provided through which means for adjusting the position of the guide bar 5 on the housing 2 for tightening the saw chain 6 can project. The lateral panel 17 has a first transverse side 41 that is facing the drive pinion 8. The lateral panel 17 is also provided with a second transverse side 42 that is facing away from the drive pinion 8. The two transverse sides 41 and 42 extend transversely to the circulating direction 21 of the saw chain 6.

Figure 11:
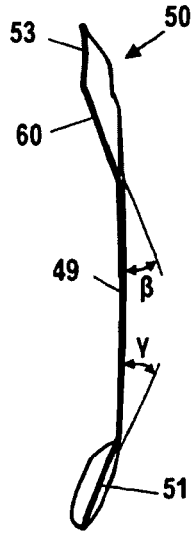
FIG. 11 shows a section along the line XI-XI of FIG. 10.
Figure 12:
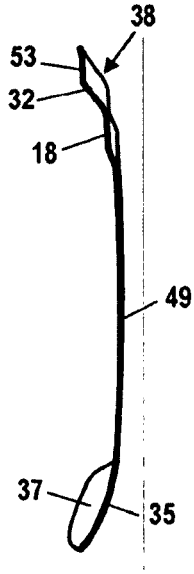
FIG. 12 shows a section along the line XII-XII of FIG. 10.
Figure 13:
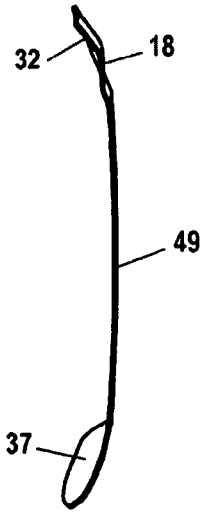
FIG. 13 shows a section along the line XIII-XIII of FIG. 10.
Figure 14:
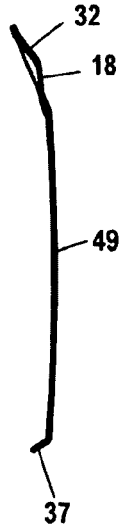
FIG. 14 shows a section along the line XIV-XIV of FIG. 10.
Figure 15:
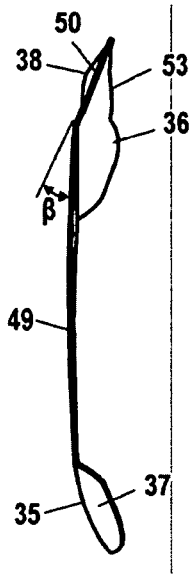
FIG. 15 shows a side view in the direction of arrow XV of FIG. 10.
Figure 16:
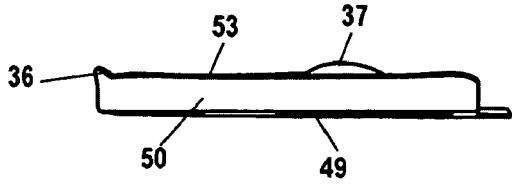
FIG. 16 shows a side view in the direction of arrow XVI of FIG. 10.

The upper longitudinal section 50 extends along the longitudinal side of lateral panel 17 where the saw chain 6 is moving away from the drive pinion 8. The upper longitudinal section 50 as a base surface 60 that is slanted relative to the baseplate 49 at an angle β. This is shown in FIG. 11. A bulge 38 projects from the base surface 68. On the bulge 38 the guide 18 as well as the slanted section 32 of the lateral plate 17 are provided. The bulge 38 has a first leading end in the circulating direction 21 as well as a second trailing end 40 in the circulating direction 21. At both ends 39 and 40 the bulge 38 passes into the base surface 60. The lateral panel 17 is positioned with base surface 60 on the housing wall 56 shown in FIGS. 3 and 4. In this way, the bulge 38 is closed off by the housing wall 56. The upper longitudinal section 50 is delimited by an upper longitudinal edge 53 of the lateral panel 17.

On the side of the baseplate 49 opposite the upper longitudinal section 50 a lower longitudinal section 51 is provided. The lower longitudinal section 51 is delimited by a lower longitudinal edge 54. The lower longitudinal section 51 has a bulge 48 on which a third lower guide 35 for the saw chain 6 is formed. This is also shown in FIG. 3. As shown in FIG. 10, on the leading edge of the bulge 48 in the circulating direction 21 there is a lower ramp 37 where the lateral panel 17 is bent toward the housing 2. On the trailing end 47 in the circulating direction 21 the bulge 48 is closed and passes into the base surface of the lower longitudinal section 51. The lower ramp 37 is displaced to the rear relative to the second transverse side 42 of the lateral plate 17 in the circulating direction 21.

At the upper longitudinal section 50 on the leading side in the circulating direction 21, i.e., on the first transverse side 41 of the lateral panel 17, a ramp 36 is formed where the lateral panel 17 is bent toward the housing 2. The ramp 36 is spaced at a distance relative to the first end 39 of the bulge 38 in the circulating direction 21. As shown in FIGS. 9 and 10, the lateral panel 17 has a step 52 at its second transverse side 42. The side of the lateral panel 17 correlated with the lower longitudinal section 51 is thus longer in the circulating direction 21 than the side correlated with the upper longitudinal section 50.

As shown in FIG. 11, the base surface of the lower longitudinal section 51 is slanted relative to the baseplate 49 at an angle γ. The angles β and γ can be within a range of approximately 15 degrees to approximately 50 degrees.

Figure 17:
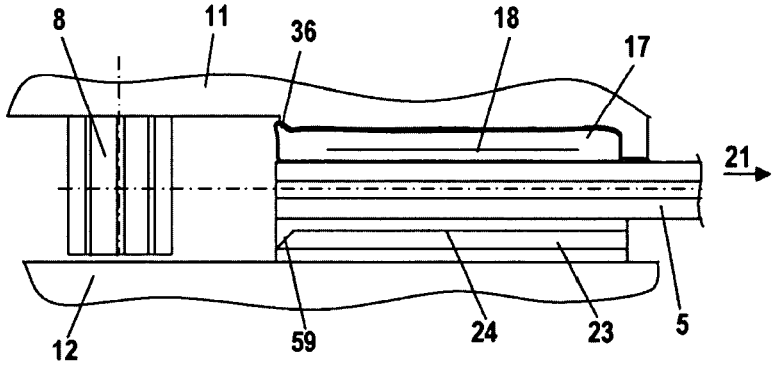
FIG. 17 is a schematic illustration of a motor chain saw in the area of the drive pinion and the guide bar.
Figure 18:
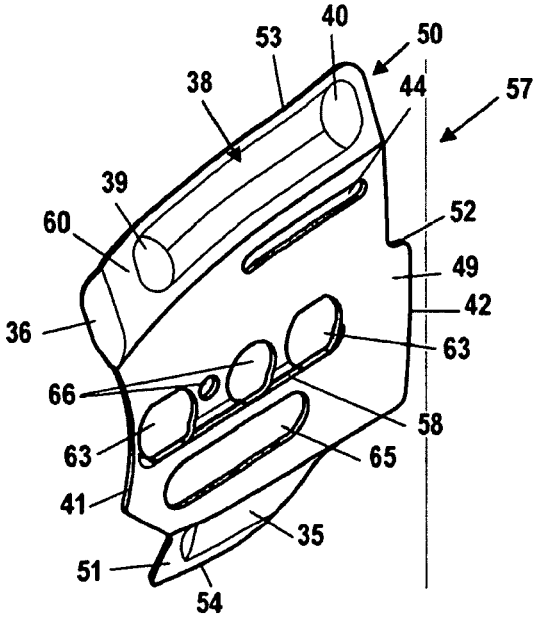
FIG. 18 is a perspective illustration of another embodiment of a lateral panel.
Figure 19:
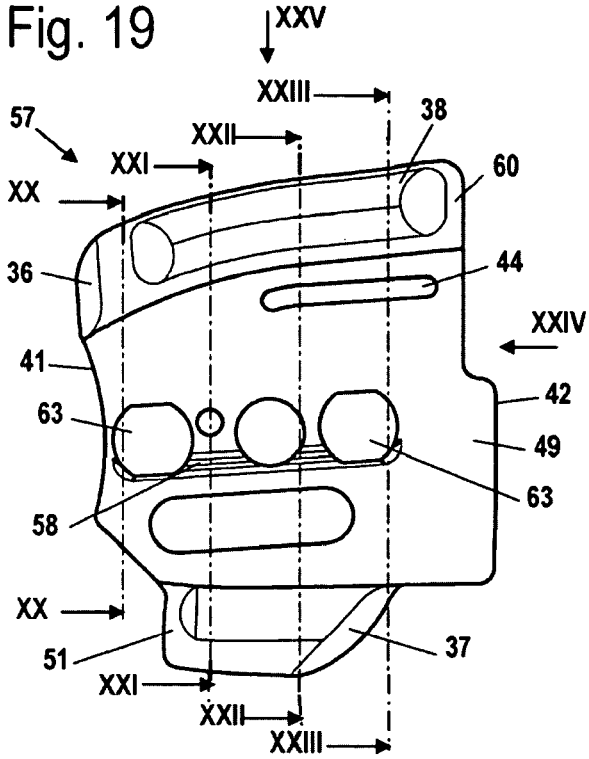
FIG. 19 shows the lateral panel of FIG. 18 in a side view.
Figure 20:
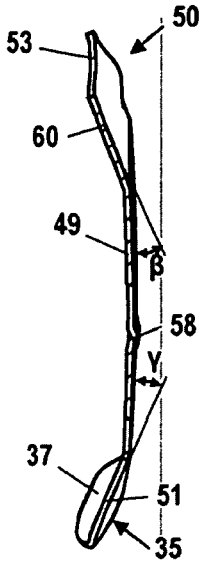
FIG. 20 is a section along the line XX-XX of FIG. 19.
Figure 21:
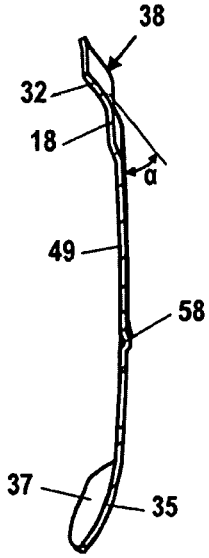
FIG. 21 is a section along the line XXI-XXI of FIG. 19.
Figure 22:
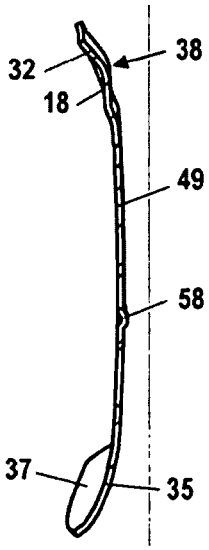
FIG. 22 is a section along the line XXII-XXII of FIG. 19.
Figure 23:
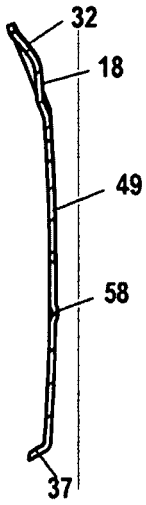
FIG. 23 is a section along the line XXIII-XXIII of FIG. 19.
Figure 24:
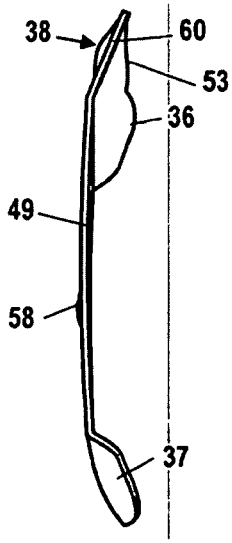
FIG. 24 is a side view in the direction of arrow XXIV of FIG. 19.
Figure 25:
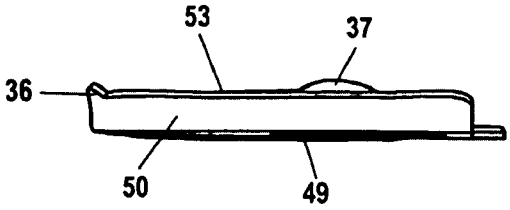
FIG. 25 is a side view in the direction of arrow XXV of FIG. 19.

FIG. 17 shows a schematic top view of the drive pinion 8 and the first guide 18 arranged on the lateral panel 17 and the second guide 24 on the sprocket wheel cover 12. As shown in FIG. 17, a ramp 59 is provided on the guide strip 23 for the second guide 24 on the sprocket wheel cover 12 and is arranged in the circulating direction 21 in front of the second guide 24. The two ramps 36 and 59 converge in the circulating direction 21 to the level of the guides 18 and 24 in a V-shape. In this way, the saw chain 6 is centered between the ramps 36, 59. As shown in FIG. 17, in the area of the drive pinion 8 there is no lateral guiding action for the saw chain 6.

FIGS. 18 to 25 show another embodiment of a lateral panel 57. The lateral panel 57 is substantially embodied in the same way as the lateral panel 17. Same reference numerals indicate same elements of both lateral panels. The lateral panel 57 differs from the lateral panel 17 substantially in the area of the baseplate 49. The lateral panel 57 has openings 63 for the fasting bolts 13 embodied as slotted holes. The through openings 66 have a different shape in comparison to the through openings 46 of the lateral panel 17. The longitudinal groove 65 of the lateral panel 57 is wider than that of the lateral panel 17. The lateral panel 57 has in the area of the sides of the openings 63 facing the lower longitudinal section 51 a longitudinal crimp or corrugation 58 that extends in the area of the two openings 63 and between them. The longitudinal crimp or corrugation 58 can be provided as a reinforcing means for the lateral panel 57.

Both lateral panels 17 and 57 are advantageously configured as stamped and bent parts. The bulges 38 and 48 can be configured as corrugations.

The specification incorporates by reference the entire disclosure of German priority document 10 2007 045 240.5 having a filing date of Sep. 21, 2007.

While specific embodiments of the invention have been shown and described in detail to illustrate the inventive principles, it will be understood that the invention may be embodied otherwise without departing from such principles.

What is claimed is:

1. A motor chain saw comprising:

a housing;

a motor arranged in the housing;

a drive pinion driven by the motor;

a guide bar connected to the housing;

a saw chain extending about the guide bar and driven in circulation about the guide bar by the drive pinion;

a lateral panel arranged between the housing and an attachment section of the guide bar;

wherein the lateral panel has a first guide that guides the saw chain and is arranged adjacent to rivets of the saw chain, wherein the first guide extends approximately parallel to the plane of the guide bar;

wherein the lateral panel has a slanted section neighboring a cutter of the saw chain, wherein the slanted section is slanted away from the cutter;

wherein the lateral panel has an upper longitudinal section provided with a bulge, wherein the first guide and the slanted section are formed on the bulge;

wherein the upper longitudinal section has a base surface that is slanted relative to a base plate of the lateral panel in a direction away from the guide bar;

wherein the base surface of the upper longitudinal section rests against a housing wall of the housing and wherein the bulge has a leading end and a trailing end in the circulating direction, wherein the leading and trailing ends pass into the base surface of the upper longitudinal section.

2. The motor chain saw according to claim 1, wherein, when the saw chain is guided centrally on the guide bar, the first guide has a distance relative to the rivets of the saw chain of approximately 0.5 mm to approximately 1.0 mm.

3. The motor chain saw according to claim 1, wherein the slanted section is slanted at an angle of approximately 20 degrees to approximately 50 degrees relative to a plane of the first guide.

4. The motor chain saw according to claim 1, further comprising a sprocketwheel cover, wherein the attachment section of the guide bar and the drive pinion are covered by the sprocket wheel cover, wherein the sprocket wheel cover has a second guide that guides the rivets of the saw chain on a side of the saw chain facing away from the lateral panel.

5. The motor chain saw according to claim 4, wherein the second guide extends parallel to the plane of the guide bar.

6. The motor chain saw according to claim 4, wherein the guide bar and the lateral panel each are spaced at a distance from the drive pinion and wherein a first ramp for the saw chain is arranged in the circulating direction in front of the first guide and a second ramp for the saw chain is arranged in the circulating direction in front of the second guide.

7. The motor chain saw according to claim 6, wherein the first ramp and the second ramp converge in the circulating direction of the saw chain in a V-shape.

8. The motor chain saw according to claim 4, wherein the sprocket wheel cover comprises a guide strip and wherein the second guide is formed on the guide strip.

9. The motor chain saw according to claim 8, wherein the guide strip is comprised of plastic material.

10. The motor chain saw according to claim 1, wherein the lateral panel has a lower guide that, in the circulating direction, is arranged in front of the drive pinion on a lower longitudinal section of the lateral panel.

11. The motor chain saw according to claim 10, wherein a lower ramp is arranged in the circulating direction in front of the lower guide on the lateral panel.

12. The motor chain saw according to claim 1, wherein, in the circulating direction, a ramp for the saw chain is provided in front of the first guide.

13. The motor chain saw according to claim 1, wherein the lateral panel has at least one opening for fastening means of the guide bar and at least one lubrication groove for supplying a lubricant to the guide bar.

14. The motor chain saw according to claim 1, wherein the lateral panel is a bent sheet metal.

* * * * *